United States Patent [19]

Nilsson

[11] Patent Number: 4,823,674

[45] Date of Patent: Apr. 25, 1989

[54] ANTI-AIRCRAFT SIGHT

[75] Inventor: Hans-Arne Nilsson, Jönköping, Sweden

[73] Assignee: Saab Instruments Aktiebolag, Jonkoping, Sweden

[21] Appl. No.: 44,850

[22] PCT Filed: Aug. 18, 1986

[86] PCT No.: PCT/SE86/00372

§ 371 Date: Apr. 6, 1987

§ 102(e) Date: Apr. 6, 1987

[87] PCT Pub. No.: WO87/01190

PCT Pub. Date: Feb. 26, 1987

[30] Foreign Application Priority Data

Aug. 19, 1985 [SE] Sweden ..... 8503860

[51] Int. Cl.[4] ..... F41G 3/06; F41G 5/08

[52] U.S. Cl. ..... 89/41.22; 33/238; 235/411

[58] Field of Search ..... 89/41.22, 41.09; 364/423; 235/411–416; 33/236, 237, 238

[56] References Cited

U.S. PATENT DOCUMENTS

| | | | |
|---|---|---|---|
| 3,135,053 | 6/1964 | Newman et al. | 235/412 |
| 3,845,276 | 10/1974 | Kendy et al. | 89/41.22 |
| 3,848,509 | 11/1974 | Corn | 89/41.22 |
| 3,992,708 | 11/1976 | Olson et al. | 235/411 |
| 4,004,729 | 1/1977 | Rawicz et al. | 33/238 |
| 4,011,789 | 3/1977 | Bresee et al. | 235/416 |
| 4,146,780 | 3/1979 | Sprey | 89/41.22 |
| 4,266,463 | 5/1981 | Saltin | 89/41.22 |
| 4,402,250 | 9/1983 | Baasch | 89/41.22 |

*Primary Examiner*—David H. Brown

*Attorney, Agent, or Firm*—James E. Nilles; James R. Custin

[57] ABSTRACT

A sight for an anti-aircraft gun, which is manually aimed, comprises a ranging unit, a gun-fixed aiming unit and a calculating unit, preferably a computer. The ranging unit comprises means for optical aiming at the target, and devices for determination of the range, the angular rate in elevation and azimuth, and elevation. The devices emit measured value signals to the means for optical aiming at the target, which means is settable in elevation and azimuth in relationship to the firing direction of the anti-aircraft gun. The calculating unit controls, guided by said received signals and information given about the velocity of the fired projectile and the prevailing wind vector, the second optical means in such a way, that, when the operator aims through same at the target, by setting the barrel in elevation and azimuth, the offset- and lead angles of the barrel are such, that a fired projectile hits the target. The invention is characterized in that the ranging unit (1) is separate, comprising a support (9), manually pivotable in elevation and azimuth, independent of the firing direction of the barrel.

8 Claims, 4 Drawing Sheets

ANTI-AIRCRAFT SIGHT

The present invention relates to a sight for aiming at a mobile target of an anti-aircraft gun or the like which is manually aimed in elevation and azimuth, comprising a ranging unit, an aiming unit fixed to the gun and a calculating unit, preferably a computer, the ranging unit comprising first means for optical aiming at the target along a first aiming line, preferably fieldglasses, a device for ranging to the target, preferably of the laser type, devices for measuring the angular rates of the aiming line in elevation and azimuth, preferably gyros, the sight also comprising a device for measuring the elevation, which at least contributes to the measurement of the elevation of the ranging unit, preferably an electrically sensed pendulum, said mentioned devices being provided to emit signals corresponding to their respective measured values to the calculating unit, the aiming unit comprising second means for optical aiming at the target, which means is controllable in elevation and azimuth in relationship to the firing direction of the anti-aircraft gun the calculating unit being provided, quided by said received signals, and information given about the velocity of the projectile fired from the anti-aircraft gun and the prevailing wind vector, to control the second optical means so that when aiming through same at the target, the lead angle and the offset angle of the barrel of the anti-aircraft gun are such, that a fired projectile will hit the target.

When fighting against mobile targets with an anti-aircraft gun there are different methods for aiming. The most simple one, but also the least reliable, implies so called direct aiming, in which the aiming operator judges, by experience, the lead angle and the offset angle by tracking the target through a simple ring sight. The aiming is entirely manual. In order to improve such manual aiming of an anti-aircraft gun its barrel has been provided with gyros measuirng its angular rates, emitting signals corresponding to the angular rates of the barrel in elevation and azimuth to a calculating unit, which in turn emits control signals to an optical sight, the aiming line of which is controllable in relationship to the direction of the barrel of the anti-aircraft gun. The control signals have the object to control the sight in relationship to the firing direction, so that the aiming operator, by aiming at the target and simultaneously setting the firing direction in elevation and azimuth, shall bring about such lead and offset angles that a fired projectile will hit the target. As the gyros measuring the angular rates are fixed to the gun, the measurement is disturbed by their movement together with the setting of the barrel, so that the method implies a dependent aiming line method.

The development of systems for fire-control of anti-aircraft guns comprises remote control of barrels from a central ranging unit from which the range to the target is determined and its velocity and track in an earth-bound coordinate system and with the aid of a calculating unit the anti-aircraft gun is remotely controlled by servo means, so that the lead- and offset angles for the barrel are the correct ones for firing the projectile. the range determination in such a central ranging unit is carried out by radar or by a laser meter provided with a thoroughly gyro stabilized sight. Such equipment is expensive and complicated. The manual aiming of the barrel is completely eliminated in these fire-control systems, which apply an independent aiming line method.

As there are still several manually aimed anti-aircraft guns, which are not suited to rebuild for remote control, there is a demand for a sight for the application of an independent aiming line method for manually aimed anti-aircraft guns. This sight should be simple and reliable and should permit a high degree of hit precision. The object of the invention is thus to provide a sight of the art mentioned introductorily, which bears said desired features. Further, the sight shall be so stable when aiming without gyro-stabilizing, that the range determination can be carried out simply by a laser meter.

Such a sight is characterized, according to the invention, in that the ranging unit is separate, comprising a support, manually pivotable in elevation and azimuth, independent of the firing direction of the anti-aircraft gun. The sight can be designed in many ways, either carried by an operator or by a stand which can be located at a distance from the anti-aircraft gun, or be mounted on the barrel of the anti-aircraft gun. In one embodiment the support of the ranging unit is pivotable in elevation around a substantially horizontal first axis in a yoke, intended to be carried and be turned in azimuth by an operator. Suitably the yoke is designed to be carried at the shoulders of an operator. The support of the ranging unit can be designed in many ways. If it is intended to be carried by an operator, as has just been described, the support is suitably formed by two relatively long and narrow beams, in one end, that is to say the end pointing in the direction of the operator's sight, provided with two handles, intended to be held by the operator. The yoke can also be formed by two long plates, provided on the lower side of the support, intended to be laid upon the shoulders of the operator. In this case there is no separate bearing of the yoke, but the yoke is turned in elevation directly at the shoulders of the operator. The operator shall, in the initial position, hold the support so that it takes a horizontal position in the sight direction as well as in the direction perpendicular to this. In order to facilitate this, means as well as devices should be mounted in such a way on the support, that the ranging unit will balance substantially horizontally in the yoke. The first optical means and the ranging unit are naturally placed in the front part of the support, whilst the other devices are attached to its rear part, where also the calculating unit is advantageously placed. The signals from the calculating unit to the aiming unit can be transferred in different ways, but the most reliable way is probably to use an electrical cable, even if a radio transmission can also be considered.

For aiming units, intended for use separated from the anti-aircraft gun, a device for azimuth measurement is suitably used.

There are different types of such devices. In this context a compass with electrical sensing should be considered firstly. Such a device is placed in a cradle, pivoted in a second axis, perpendicular to the longitudinal axis of the support, substantially parallel to the first axis. A more expensive device is formed by means for inductive measurement of the earth magnetic field vector and means for separating the azimuth angle. It is not necessary to mount such a device in a cradle but it can be attached directly to the support. As it is not possible for the operator to hold the ranging unit uninterruptedly so that the first axis, around which the yoke is pivoted is positioned horizontally, the ranging unit suitably comprises a device for measuring the deviation of said first axis from the horizontal plane, that is to say the inclination of the ranging unit around its longitudinal axis, which device is suitably mounted in a cradle, pivoted in a second axis, perpendicular to the longitudinal axis of the support, substantially parallel to the first axis, which device is preferably an electrically sensed pendulum, provided to emit a corresponding deviation signal to the calculating unit, which is provided to correct, with the aid of the deviation signal, said signals, corresponding to measured values for the angular rate perpendicular to the aiming line through the first optical means in elevation and azimuth, to values for the ranging unit in a position with the first axis in a horizontal position.

The embodiment just described, where an operator is presumed to carry the ranging unit can be advantageous in many cases. Considering that the ranging unit is normally rather heavy, an embodiment may in some cases be preferable where the support is pivoted in elevation around an axis, which is carried by a portable stand. The turnability in azimuth can be achieved by a bearing or by suspension in an elastic element like a strong rubber band. Even in this case it is presumed that an operator is present below the stand, handling same in elevation and azimuth. Of course a combination of said embodiments may be considered, where for instance the ranging unit is pivoted in a yoke, intended to be carried by the shoulders of an operator, the weight of the yoke being partly relieved for instance by an elastic suspension in a portable stand like a tripod.

One further embodiment may be considered and shows advantages in some cases. Then the support of the ranging unit is pivoted in elevation and azimuth in a base which is firmly connected to the barrel of the anti-aircraft gun. In order to improve the possibilities for a safe aiming it is suitable to provide the support of the ranging unit with a handle, arranged to act upon the elevation and azimuth movement by reduction of movement when the operator acts upon the handle.

In all embodiments the ranging unit is located, together with the first optical means in a certain distance from the aiming unit with its second optical means. This is, of course, true in the least degree regarding the embodiment in which the support of the ranging unit is pivoted in a base firmly connected to the barrel. Thus the calculating unit is suitably arranged to correct the angle difference between the aiming lines through the first and the second optical means, depending upon a signal given to the calculating unit, corresponding to the mutual positions of said optical means.

The invention shall now be described more in detail, reference being made to the accompanying figures, among which FIG. 1 shows, schematically, seen from above, an embodiment of the sight of the invention, utilized when shooting with an antiaircraft gun;

Figure 1:
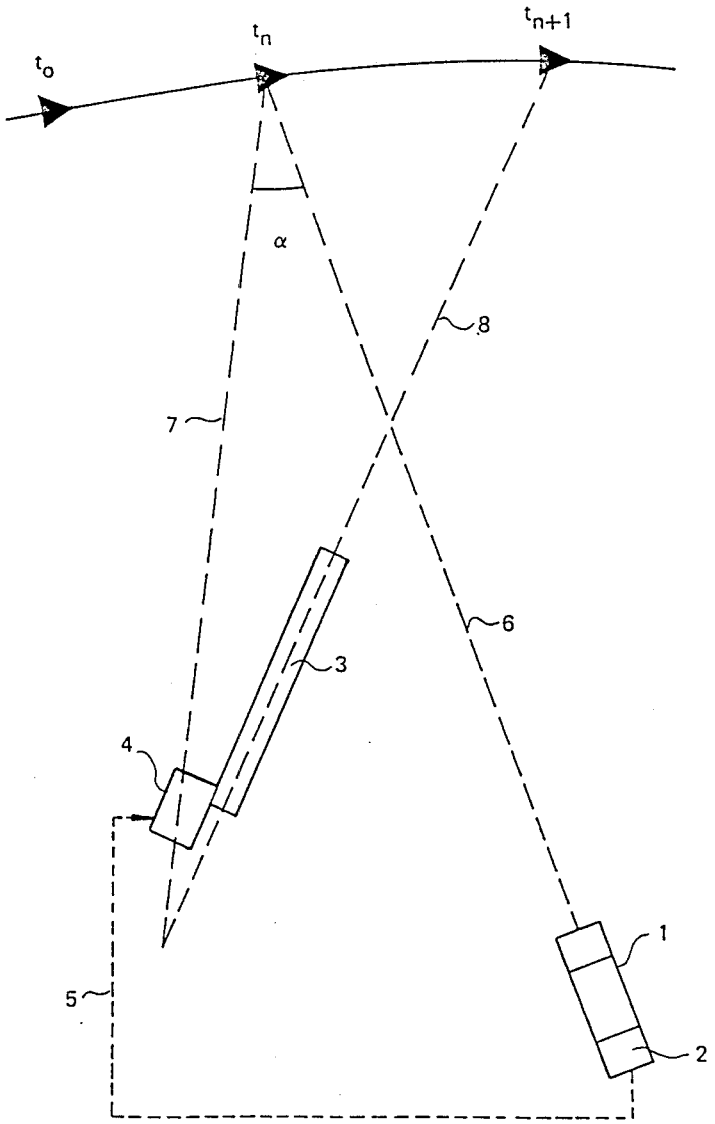

In FIG. 1, 1 designates a ranging unit according to the invention and 2 a calculating unit. The latter is in this case mounted on the former. An anti-aircraft gun, which is aimed manually, is shown exclusively with a barrel 3, which is firmly connected to an aiming unit 4. The calculating unit 2 is connected to the aiming unit 4 by an electrical cable. In practice this connection can be arranged in such a way that an electrical cable 5 leads to the lower gun-carriage of the anti-aircraft gun, from which the signal transfer to the aiming unit 4, which is located in the corresponding upper gun-carriage, is carried out by inductive transmission. With this arrangement the upper gun-carriage can be turned freely in relationship to the lower gun-carriage. A mobile target moves in a track which is marked by the three successive positions $t_o - t_n - t_{n+1}$. By the aid of the ranging unit 1 the target is aimed at along a first aiming line 6, which in its initial position is thus aiming at the target in the position $t_o$. By determining the range to the target and tracking it, so that the velocity and the track are determined, measured values are obtained, which are converted by the calculating unit 2 into control signals which control the aiming means 4 of the aiming unit 6 in such a way that when the aiming operator sets the barrel 3 of the anti-aircraft gun, a second aiming line 7 aims at the target, the barrel 3 being directed in such a way, that a fired projectile will hit the target after a projectile track in the position $t_{n+1}$, considering the prevailing wind vector, the velocity of the fired projectile and correction for the angles in elevation and azimuth between the aiming lines 6, 7 (of which only the latter is shown in FIG. 1) considering that the ranging unit 1 and the aiming unit 4 are located at substantially different positions, which is always the case in practice. Thus the aiming lines 6, 7 are shown in FIG. 1 in the moment when the acquisition has been going on for so long a time that the projectile can be fired with a sufficiently high degree of probability for a hit against the target in the position $t_{n+1}$.

Figure 2:
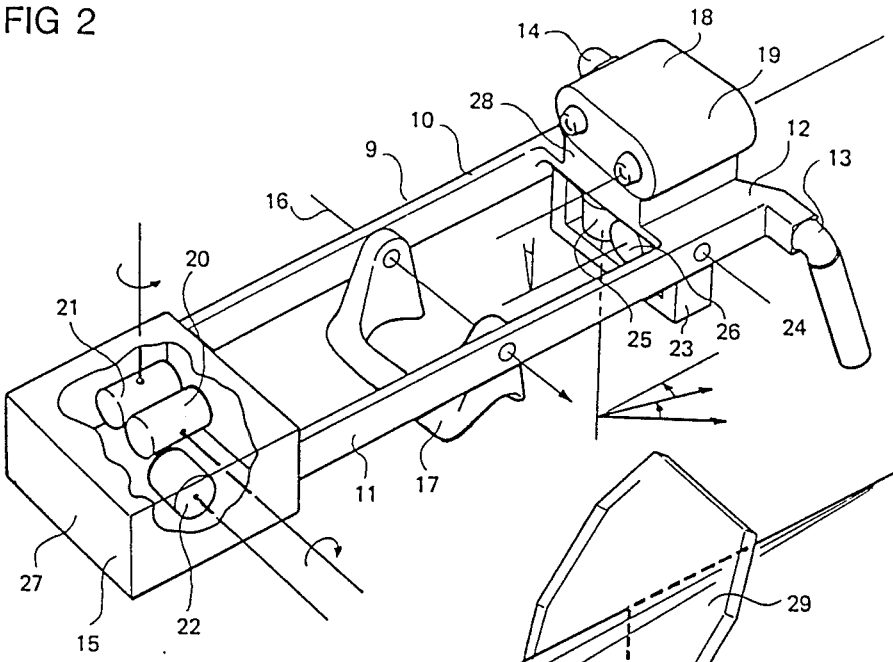
FIG. 2 shows, seen in perspective, one embodiment of a ranging unit according to the invention.

In FIG. 2 the design of the ranging unit 1 is shown more in detail. A support 9 is formed by two long narrow beams 10, 11, in one end joined by a support plate 12, which is provided with two handles 13, 14, and in the other end joined by a container 15. The support 9 is at about the middle of the longitudinal extension of the beams 10, 11 pivoted around a horizontal axis 16 in a yoke 17, designed to be carried by an operator's shoulders.

At the support plate 12 there is attached field-glasses 18 for optical aiming at the target. These field-glasses also comprise a laser range finder 19. In the container 15 there are placed gyros for angular rate measurement, for measuring in elevation 20, and azimuth 21. In the container 15 there is also a first electrically sensed pendulum 22 for elevation measurement. In the front part of the support a cradle is pivoted around a laterally extending axis 24, which is horizontal, perpendicular to the longitudinal extension of the support and thus parallel to said axis 16. In this cradle 23 an electrically sensed compass 25 is placed, as well as a second electrically sensed pendulum 26, provided to determine any deviation of the direction of the axis 24 and thus the direction of the axis 16 in relationship to the horizontal plane.

Signals corresponding to the measured values from the laser range finder 19, the gyros 20, 21 and the compass 25 and the pendulums 22 and 26 are fed to one calculating unit 27, which is not shown more in detail, placed in the container 15.

In the front part of the support 9, below the field-glasses 18, there is one instrument display 28, which is not shown in detail, where data of wind vector, projectile velocity and the position of the ranging unit in relationship to the aiming unit is set by the operator.

Figure 3:
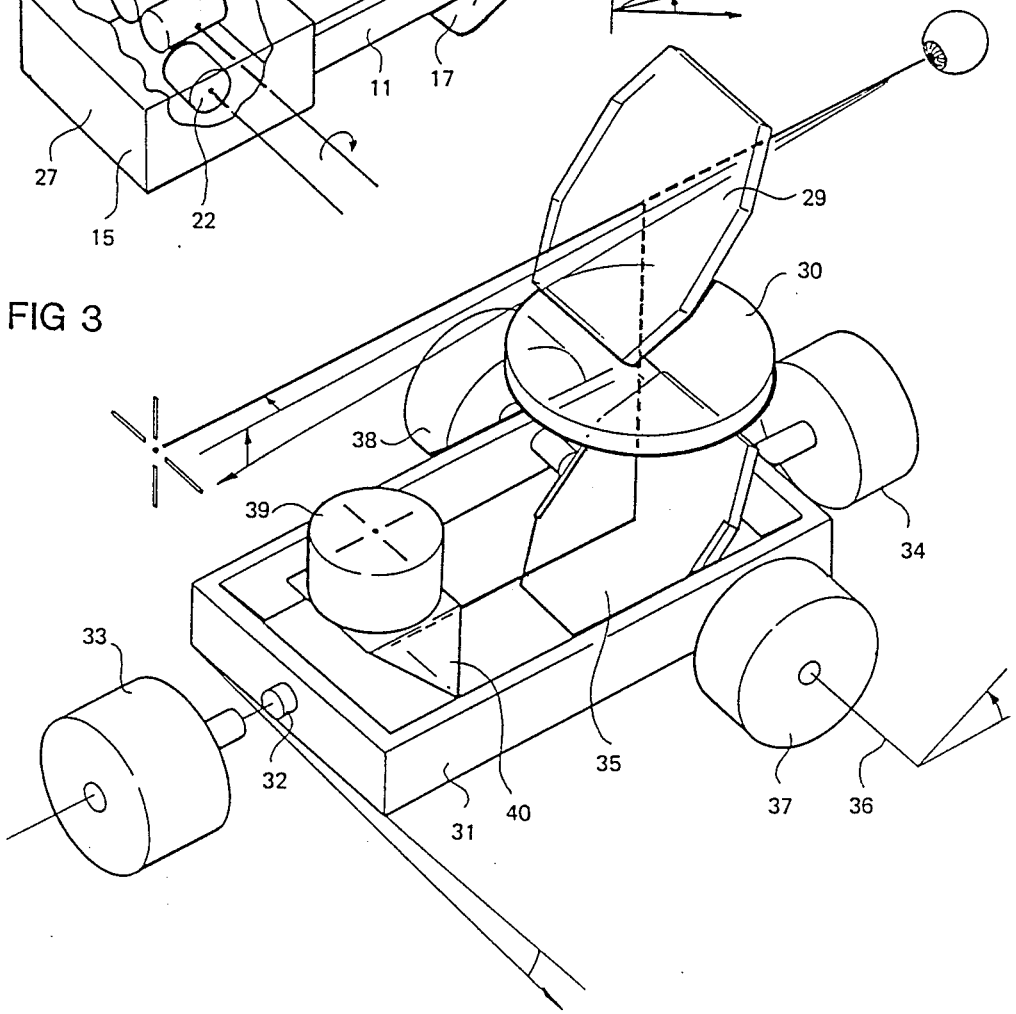
FIG. 3 shows, seen in perspective, a second optical means, which is part of an aiming unit according to the invention.

The optical means of the aiming unit 4 are shown partly in FIG. 3, where 29 means a semi-transparent first mirror, which is attached to the aiming unit 4, which is connected to the barrel 3. The same is true for a lens 30. A cradle 31 is provided, pivoted around an axis 32, perpendicular to the optical axis of the lens 30, and situated in the same plane as this. The cradle 31 is controllably turnable around the axis 32 by the aid of a first torque motor 33, firmly connected to the aiming unit, and a corresponding first position transducer 34. In the cradle 31 a second mirror 35 is provided, pivoted around an axis 36, perpendicular to the axis 32. The mirror 35 is controllably turnable around the axis 36 by the aid of a second torque motor 37, firmly connected to the cradle 31, and a corresponding second position transducer 38. In the cradle 31 there is a symbol generator 39, which creates a reticle pattern, which is projected, via a prism 40, by the second mirror 35, through the lens 30 and via the semi-transparent first mirror and seems to be visible at an infinite distance from an observer, who looks through the first, semi-transparent mirror 29. By turning the cradle 31 around axis 32 and the mirror 35 around the axis 36, the reticle will be displaced in azimuth and elevation. These turning movements are controlled, as is obvious from what is said above, by the calculating unit guided by the signals received by same, in such a way, that when the aiming operator sets the barrel 3 in elevation and azimuth, with the object to aim through the optical means of the aiming unit 4 so, that said reticle coincides with the target, the barrel will be directed in such a way, that a fired projectile will hit the target.

The simple, balanced design of the ranging unit permits a stabilized ranging of the target without any expensive gyro stabilization. The stability is such, that the necessary ranging can be carried out by a simple laser range finder, measuring in intervals of about 0.5 to 1 second. Such a finder has normally a beam divergence of 1–2 mradians, which means, that the sight stability must be of corresponding quality. According to the invention there is applied a safe, independent aiming line method for manually aiming of an anti-aircraft gun.

Figure 4:
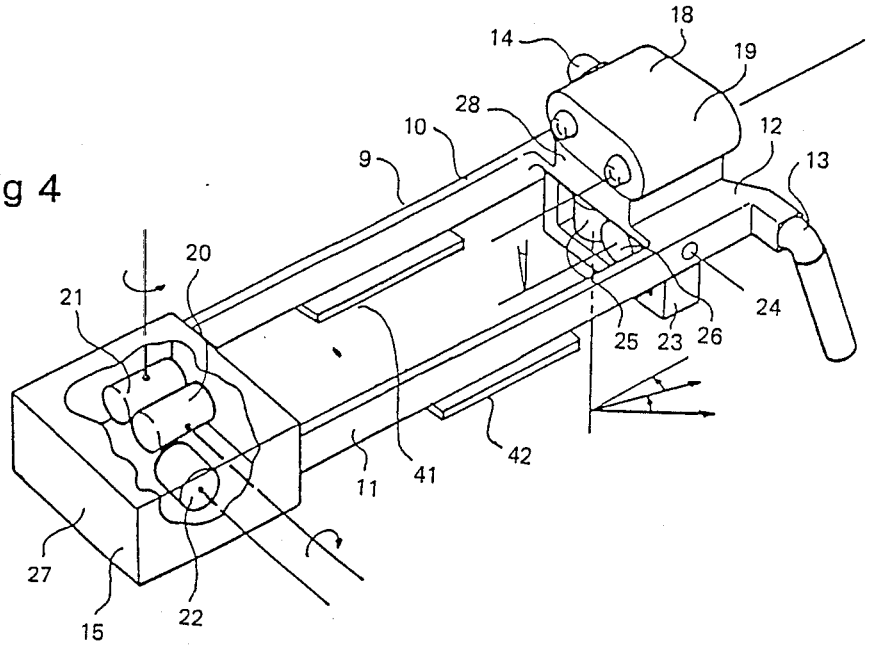
FIGS. 4 and 5 show two variants of the ranging unit in FIG. 2.

In one alternative embodiment of the ranging unit according to the invention, which is shown in FIG. 4, the support is provided, at the lower side, with two elongated plates 41 and 42, intended to be laid upon the shoulders of the operator.

Figure 5:
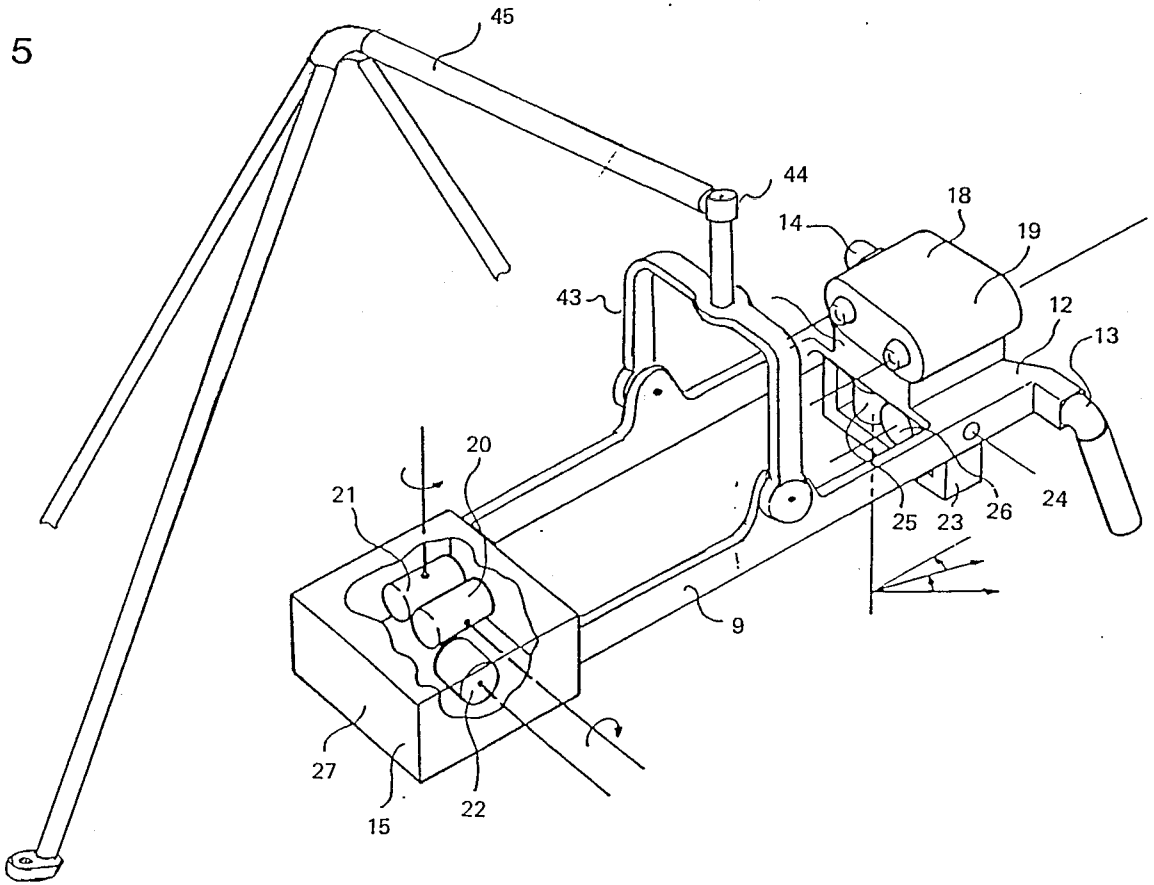

In FIG. 5 there is shown one embodiment of the ranging unit, where the support 9 is pivoted in elevation in a clamp 43, which in turn is pivoted in azimuth in a bearing 44, attached to a portable tripod 45, which is shown only partly in the figure. With this arrangement the operator is relieved. This is done, however, at the expense of the flexibility, as it demands a certain effort to move the tripod into a desired position. The turnability in azimuth can, of course, be achieved in several different ways, for instance by using a strong rubber band for suspension of the ranging unit in the support 45.

Figure 6:
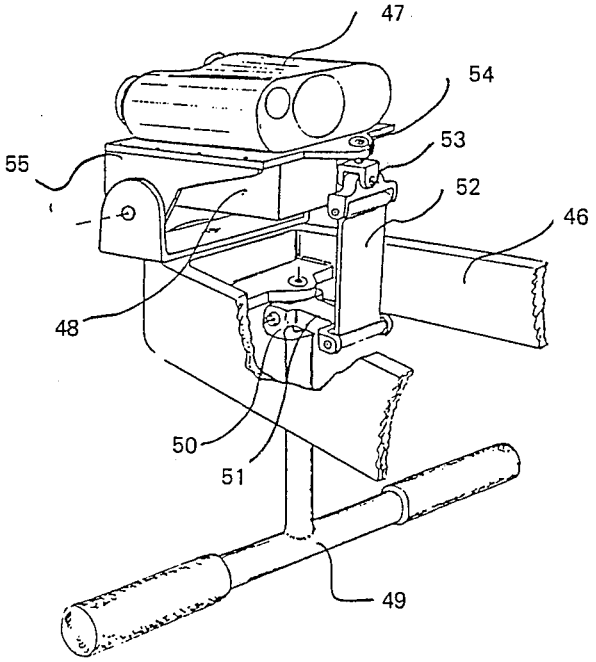
FIG. 6 shows, seen in perspective one further embodiment of a ranging unit according to the invention.

In the embodiment shown in FIG. 6, the ranging unit has been designed differently compared to the one shown in FIGS. 2, 4 and 5. Here the ranging unit is mounted, pivoted in elevation and in azimuth in a support 46, which is attached to the barrel of the anti-aircraft gun. Field-glasses and range finder are here denoted by 47, whilst a unit 48 contains devices for angular rates and elevation angle measurement. The latter can also be placed at the barrel, in which case the elevation of the ranging unit is obtained by combination of the value from the device for elevation measurement and the value from an angular position transducer which measures the angle between the direction of the barrel and the elevation of the ranging unit. There is no need for a device for azimuth measurement in this case. In this embodiment the calculating unit is suitably separated from the ranging unit. By a handle 49, the field-glasses and the range finder 47 will be directed in elevation and azimuth by the operator, via a link system, which reduces the movement, for instance in the relationship 3:1, in order to improve the safety of the aiming.

In this case the link system comprises a fork link 51, firmly connected to the handle, pivoted in elevation and azimuth in the support 46. This fork link 51 is connected to a link 52, connected via a cardan to a journal 54, pivoted laterally in a support 55, which carries the field-glasses and the range finder 47 and the unit 48. This support 55 is pivoted in elevation and azimuth to the base 46. There are, of course, other constructive solutions to the problem of aiming a ranging unit in elevation and azimuth in relationship to a gun-fixed base. The design shown is however robust and reliable.

The last described embodiment of the ranging unit has the advantage that the anti-aircraft gun with operator constitutes a defined unit, but the operator serving the ranging unit has not the same liberty of movement as in the cases when he himself carries a free ranging unit.

I claim:

1. A ranging unit for a gun such as an anti-aircraft gun that is normally fired at moving targets and comprises a barrel with a barrel axis an aiming unit which is mounted on the barrel for angular adjusting motion relative to it and which defines an aiming axis that a gunner manually maintains aligned on a target during a period terminating at an instant of firing to thus aim the barrel, and servo means reacting between the barrel and the aiming unit and responsive to outputs from a calculating device for angularly adjusting said aiming axis relative to said barrel axis in accordance with lead and offset angles needed for an projectile fired from the gun to hit the target, said ranging unit comprising:

A. An elongated frame having
   (1) a front end portion,
   (2) an opposite rear end portion,
   (3) a pair of laterally spaced apart side members between said portions, and
   (4) yoke means on said side members engageable with shoulders of an operator by whom the frame is supported and whose turning swings the frame about a vertical axis, said yoke means providing for tilting of the frame about a horizontal azis transverse to its length;

B. optical means on the front portion of said frame through which an operator supporting the frame can view a target and which defines a sighting axis that is fixed on the frame to be maintained aligned on a target by the operator's turning and by manual tilting of the frame about said horizontal axis;

C. a laser ranging device fixed on said front portion of the frame and connected with said calculating device, said laser ranging device being arranged (1) to emit and receive laser beam radiations along a laser axis substantially coinciding with said sighting axis and (2) to produce range outputs which correspond to distances from the sighting unit to a target aligned with said sighting axis and which are delivered to said calculating device as inputs for the latter;

D. azimuth determination means mounted on said frame and connected with said calculating device, said azimuth determination means being arranged (1) to detect a function of swinging of said frame about said vertical axis and (2) to produce azimuth outputs corresponding to that function which are delivered to said calculating device as inputs thereto; and E. elevation determination means mounted on said frame and connected with said calculating device, said elevation determination means being arranged (1) to detect a function of tilting of said frame about said horizontal axis and (2) to produce elevation outputs corresponding to that function which are delivered to said calculating device as inputs thereto.

2. The ranging unit of claim 1 wherein said calculating device is mounted on the rear portion of said frame.

3. The ranging unit of claim 1 wherein said yoke has coaxial pivotal connections to said side members to provide for tilting of the frame about said horizontal axis relative to the yoke.

4. The ranging unit of claim 1, further characterized by: a pair of laterally opposite handles on said front portion of the frame whereby an operator on whose shoulders the frame is supported can manually tilt the frame about said horizontal axis.

5. The ranging unit of claim 1, further characterized in that said elevation determination means comprises:

(1) electrical sensing means, comprising a pendulum suspended from said frame for swinging about a pendulum axis which is parallel to said horizontal axis, for producing an output corresponding to the relationship between horizontal and the tilt of said frame about said horizontal axis and (2) elevation gyro means on the frame arranged to sense the angular rate of tilting of the frame about said horizontal axis.

6. The ranging unit of claim 1, further characterized in that said azimuth determination means comprises:

(1) a magnetically responsive azimuth device for inductive determination of the earth's magnetic field vector, (2) a cradle which is pendantly suspended from said frame for swinging about a second horizontal axis parallel to the first mentioned horizontal axis and upon which said magnetically responsive device is mounted to be maintained in a level attitude.

7. The ranging unit of claim 6 wherein said azimuth determination means further comprises:

azimuth gyro means on the frame arranged to sense the angular rate of swinging of the frame about said vertical axis.

8. The ranging unit of claim 7, further characterized in that:

(1) said cradle is mounted on the front portion of said frame and (2) said azimuth gyro means is mounted on the rear portion of said frame.

* * * * *